US006428686B1

(12) United States Patent
Ackerson et al.

(10) Patent No.: US 6,428,686 B1
(45) Date of Patent: Aug. 6, 2002

(54) TWO PHASE HYDROPROCESSING

(75) Inventors: Michael D. Ackerson; Michael S. Byars, both of Fayetteville, AR (US)

(73) Assignee: Process Dynamics, Inc., Fayetteville, AR (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/599,913

(22) Filed: Jun. 22, 2000

Related U.S. Application Data

(63) Continuation of application No. 09/104,079, filed on Jun. 24, 1998, now Pat. No. 6,123,835.
(60) Provisional application No. 60/050,599, filed on Jun. 24, 1997.

(51) Int. Cl.[7] ..... C10G 45/22

(52) U.S. Cl. ..... 208/213; 208/58; 208/59; 208/60; 208/209; 208/254 H; 208/251 H; 208/142; 208/143; 208/144; 208/145; 518/700; 518/705

(58) Field of Search ..... 208/213, 58, 59, 208/60, 209, 254 H, 251 H, 142, 143, 144, 145; 585/266; 518/700, 705

(56) References Cited

U.S. PATENT DOCUMENTS 2,646,387 A * 7/1953 Francis ..... 156/215
2,698,279 A * 12/1954 Mondria ..... 208/29
2,902,444 A * 9/1959 Shmidl ..... 208/323
2,966,456 A * 12/1960 Honeycutt ..... 208/263
3,152,981 A * 10/1964 Berlin et al. ..... 208/264
4,209,381 A * 6/1980 Kelly, Jr. ..... 134/19
4,298,451 A * 11/1981 Neuworth ..... 208/408
4,311,578 A * 1/1982 Fant et al. ..... 208/416
4,333,824 A * 6/1982 Brown et al. ..... 208/326
4,381,234 A * 4/1983 Audeh et al. ..... 208/327
4,390,411 A * 6/1983 Scinta et al. ..... 208/390
4,397,736 A * 8/1983 Low ..... 208/390
4,399,025 A * 8/1983 Fletcher et al. ..... 208/180
4,424,110 A * 1/1984 Bearden, Jr. et al. ..... 208/10
4,428,821 A * 1/1984 Baset ..... 208/428
4,441,983 A * 4/1984 Garg ..... 208/210
4,464,245 A * 8/1984 Hodek ..... 208/10
4,485,004 A * 11/1984 Fisher et al. ..... 208/112
4,486,293 A * 12/1984 Garg ..... 208/10
4,491,511 A * 1/1985 Skinner et al. ..... 208/412
4,514,282 A * 4/1985 Poynor et al. ..... 208/56
RE32,120 E * 4/1986 Low ..... 208/390
4,585,546 A * 4/1986 Bowes et al. ..... 208/253
5,496,464 A * 3/1996 Piskorz et al. ..... 208/108
5,705,052 A * 1/1998 Gupta ..... 208/57
5,856,261 A * 1/1999 Culross et al. ..... 502/325
6,123,835 A * 9/2000 Ackerson et al. ..... 208/213

* cited by examiner

*Primary Examiner*—Nadine Preisch
(74) *Attorney, Agent, or Firm*—Law Offices of Grady K. Bergen

(57) ABSTRACT

A process where the need to circulate hydrogen through the catalyst is eliminated. This is accomplished by mixing and/or flashing the hydrogen and the oil to be treated in the presence of a solvent or diluent in which the hydrogen solubility is "high" relative to the oil feed. The type and amount of diluent added, as well as the reactor conditions, can be set so that all of the hydrogen required in the hydroprocessing reactions is available in solution. The oil/diluent/hydrogen solution can then be fed to a plug flow reactor packed with catalyst where the oil and hydrogen react. No additional hydrogen is required, therefore, hydrogen recirculation is avoided and trickle bed operation of the reactors is avoided. Therefore, the large trickle bed reactors can be replaced by much smaller tubular reactor.

31 Claims, 5 Drawing Sheets

TWO PHASE HYDROPROCESSING

CROSS-REFERENCE TO RELATED APPLICATIONS

This application claims the benefit of and is a continuation of U.S. patent application, Ser. No. 09/104,079, now U.S. Pat. No. 6,123,835, filed Jun. 24, 1998, which is a continuation-in-part of U.S. provisional application, Ser. No. 60/050,599, filed Jun. 24, 1997, now abandoned.

BACKGROUND OF THE INVENTION

The present invention is directed to a two phase hydroprocessing process and apparatus, wherein the need to circulate hydrogen gas through the catalyst is eliminated. This is accomplished by mixing and/or flashing the hydrogen and the oil to be treated in the presence of a solvent or diluent in which the hydrogen solubility is high relative to the oil feed. The present invention is also directed to hydrocracking, hydroisomerization and hydrodemetalization.

In hydroprocessing which includes hydrotreating, hydrofinislling, hydrorefining and hydrocracking, a catalyst is used forreacting hydrogen with a petroleum fraction. distillates or resids, for the purpose of saturating or removing sulfur, nitrogen, oxygen, metals or other contaminants, or for molecular weight reduction (cracking). Catalysts having special surface properties are required in order to provide the necessary activity to accomplish the desired reaction(s).

In conventional hydroprocessing it is necessary to transfer hydrogen from a vapor phase into the liquid phase where it will be available to react with a petroleum molecule at the surface of the catalyst. This is accomplished by circulating very large volumes of hydrogen gas and the oil through a catalyst bed. The oil and the hydrogen flow through the bed and the hydrogen is absorbed into a thin film of oil that is distributed over the catalyst. Because the amount of hydrogen required can be large, 1000 to 5000 SCF/bbl of liquid, the reactors are very large and can operate at severe conditions, from a few hundred psi to as much as 5000 psi, and temperatures from around 400° F.–900° F.

A conventional system for processing is shown in U.S. Pat. No. 4,698,147, issued to McConaghy, Jr. on Oct. 6, 1987 which discloses a SHORT RESIDENCE TIME HYDROGEN DONOR DILUENT CRACKING PROCESS. McConaghy '147 mixes the input flow with a donor diluent to supply the hydrogen for the cracking process. After the cracking process the mixture is separated into product and spent diluent, and the spent diluent is regenerated by partial hydrogenation and returned to the input flow for the cracking step. Note that McConaghy '147 substantially changes the chemical nature of the donor diluent during the process in order to release the hydrogen necessary for cracking. Also, the McConaghy '147 process is limited by upper temperature restraints due to coil coking, and increased light gas production, which sets an economically imposed limit on the maximum cracking temperature of the process.

U.S. Pat. No. 4,857,168, issued to Kubo et al. on Aug. 15, 1989 discloses a METHOD FOR HYDROCRACKING HEAVY FRACTION OIL. Kubo '168 uses both a donor diluent and hydrogen gas to supply the hydrogen for the catalyst enhanced cracking process. Kubo '168 discloses that a proper supply of heavy fraction oil, donor solvent, hydrogen gas, and catalyst will limit the formation of coke on the catalyst, and the coke formation may be substantially or completely eliminated. Kubo '168 requires a cracking reactor with catalyst and a separate hydrogenating reactor with catalyst. Kubo '168 also relies on the breakdown of the donor diluent for supply hydrogen in the reaction process.

The prior art suffers from the need to add hydrogen gas and/or the added complexity of rehydrogenating the donor solvent used in the cracking process. Hence there is a need for an improved and simplified hydroprocessing method and apparatus.

BRIEF SUMMARY OF THE INVENTION

In accordance with the present invention, a process has been developed wherein the need to circulate hydrogen gas through the catalyst is eliminated. This is accomplished by mixing and/or flashing the hydrogen and the oil to be treated in the presence of a solvent or diluent in which the hydrogen solubility is "high" relative to the oil feed so that the hydrogen is in solution.

The type and amount of diluent added, as well as the reactor conditions can be set so that all of the hydrogen required in the hydroprocessing reactions is available in solution. The oil/diluent/hydrogen solution can then be fed to a reactor such as a plug flow or tubular reactor packed with catalyst where the oil and hydrogen react. No additional hydrogen is required, therefore, the hydrogen recirculation is avoided and the trickle bed operation of the reactor is avoided. Therefore, the large trickle bed reactors can be replaced by much smaller reactors (see FIGS. 1, 2 and 3).

The present invention is also directed to hydrocracking, hydroisomerization, hydrodemetalization, and the like. As described above, hydrogen gas is mixed and/or flashed together with the feedstock and a diluent such as recycled hydrocracked product, isomerized product, or recycled demetaled product so as to place hydrogen in solution, and then the mixture is passed over a catalyst.

A principle object of the present invention is the provision of an improved two phase hydroprocessing system, process, method, and/or apparatus.

Another object of the present invention is the provision of an improved hydrocracking, hydroisomerization, Fischer-Tropsch and/or hydrodemetalization process.

Other objects and further scope of the applicability of the present invention will become apparent from the detailed description to follow, taken in conjunction with the accompanying drawings, wherein like parts are designated by like reference numerals.

DETAILED DESCRIPTION OF THE INVENTION

We have developed a process where the need to circulate hydrogen gas or a separate hydrogen phase through the catalyst is eliminated. This is accomplished by mixing and/or flashing the hydrogen and the oil to be treated in the presence of a solvent or diluent having a relatively high solubility for hydrogen so that the hydrogen is in solution.

The type and amount of diluent added, as well as the reactor conditions can be set so that all of the hydrogen required in the hydroprocessing reactions is available in solution. The oil/diluent/hydrogen solution can then be fed to a plug flow, tubular or other reactor packed with catalyst where the oil and hydrogen react. No additional hydrogen is required therefore, hydrogen recirculation is avoided and the trickle bed operation of the reactor is avoided. Hence, the large trickle bed reactors can be replaced by much smaller or simpler reactors (see FIGS. 1, 2 and 3).

In addition to using much smaller or simpler reactors, the use of a hydrogen recycle compressor is avoided. Because all of the hydrogen required for the reaction is made available in solution ahead of the reactor there is no need to circulate hydrogen gas within the reactor and no need for the recycle compressor. Elimination of the recycle compressor and the use of, for example, plug flow or tubular reactors greatly reduces the capital cost of the hydrotreating process.

Most of the reactions that take place in hydroprocessing are highly exothermic and as a result a great deal of heat is generated in the reactor. The temperature of the reactor can be controlled by using a recycle stream. A controlled volume of reactor effluent can be recycled back to the front of the reactor and blended with fresh feed and hydrogen. The recycle stream absorbs some of the heat and reduces the temperature rise through the reactor. The reactor temperature can be controlled by controlling the fresh feed temperature and the amount of recycle. In addition, because the recycle stream contains molecules that have already reacted, it also serves as an inert diluent.

One of the biggest problems with hydroprocessing is catalyst coking. Because the reaction conditions can be quite severe cracking can take place on the surface of the catalyst. If the amount of hydrogen available is not sufficient, the cracking can lead to coke formation and deactivate the catalyst. Using the present invention for hydroprocessing, coking can be nearly eliminated because there is always enough hydrogen available in solution to avoid coking when cracking reactions take place. This can lead to much longer catalyst life and reduced operating and maintenance costs.

Figure 1:
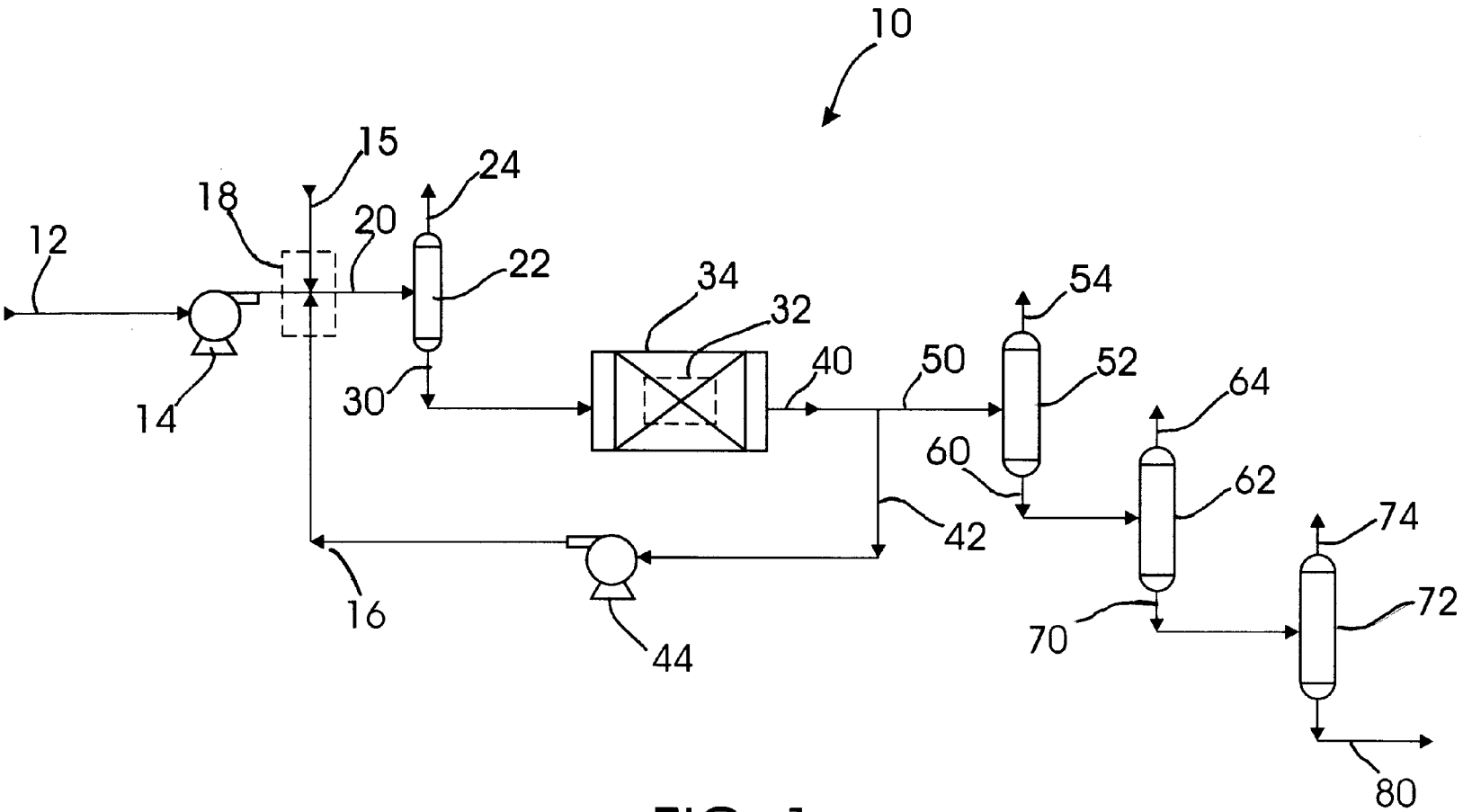
FIG. 1 is a schematic process flow diagram of a diesel hydrotreater.

FIG. 1 shows a schematic process flow diagram for a diesel hydrotreater generally designated by the numeral 10. Fresh feed stock 12 is pumped by feed charge pump 14 to combination area 18. The fresh feed stock 12 is then combined with hydrogen 15 and hydrotreated feed 16 to form fresh feed mixture 20. Mixture 20 is then separated in separator 22 to form first separator waste gases 24 and separated mixture 30. Separated mixture 30 is combined with catalyst 32 in reactor 34 to form reacted mixture 40. The reacted mixture 40 is split into two product flows, recycle flow 42 and continuing flow 50. Recycle flow 42 is pumped by recycle pump 44 to become the hydrotreated feed 16 which is combined with the fresh feed 12 and hydrogen 15.

Continuing flow 50 flows into separator 52 where second separator waste gases 54 are removed to create the reacted separated flow 60. Reacted separated flow 60 then flows into flasher 62 to form flasher waste gases 64 and reacted separated flashed flow 70. The reacted separated flashed flow 70 is then pumped into stripper 72 where stripper waste gases 74 are removed to form the output product 80.

Figure 2:
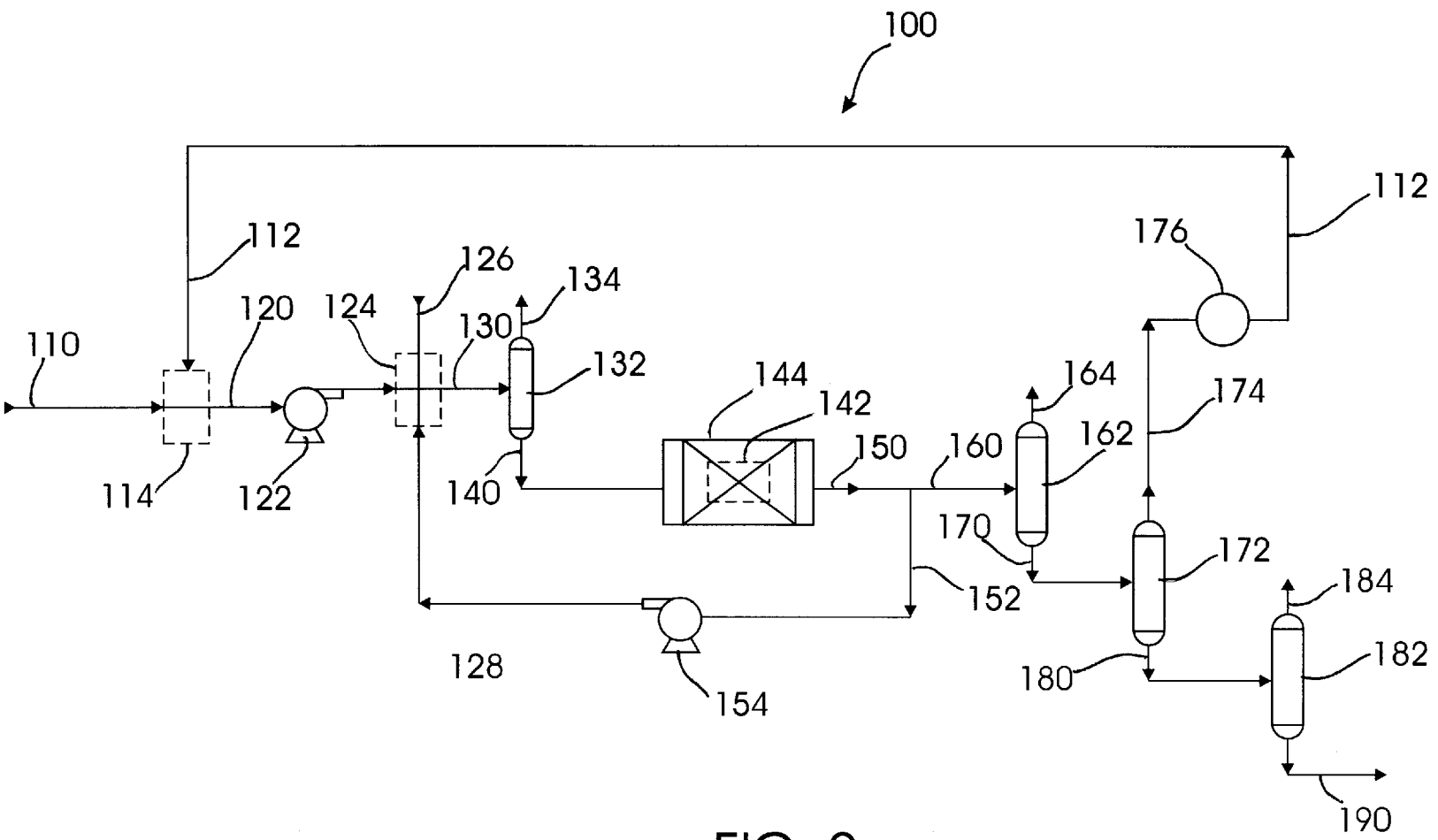
FIG. 2 is a schematic process flow diagram of a resid hydrotreater.

FIG. 2 shows a schematic process flow diagram for a resid hydrotreater generally designated by the numeral 100. Fresh feed stock 110 is combined with solvent 112 at combination area 114 to form combined solvent-feed 120. Combined solvent-feed 120 is the pumped by solvent-feed charge pump 122 to combination area 124. The combined solvent-feed 120 is then combined with hydrogen 126 and hydrotreated feed 128 to form hydrogen-solvent-feed mixture 130. Hydrogen-solvent-feed mixture 130 is then separated in first separator 132 to form first separator waste gases 134 and separated mixture 140. Separated mixture 140 is combined with catalyst 142 in reactor 144 to form reacted mixture 150. The reacted mixture 150 is split into two product flows, recycle flow 152 and continuing flow 160. Recycle flow 152 is pumped by recycle pump 154 to become the hydrotreated feed 128 which is combined with the solvent-feed 120 and hydrogen 126.

Continuing flow 160 flows into second separator 162 where second separator waste gases 164 are removed to create the reacted separated flow 170. Reacted separated flow 170 then flows into flasher 172 to form flasher waste gases 174 and reacted separated flashed flow 180. The flasher waste gases 174 are cooled by condenser 176 to form solvent 112 which is combined with the incoming fresh feed 110.

The reacted separated flashed flow 180 then flows into stripper 182 where stripper waste gases 184 are removed to form the output product 190.

Figure 3:
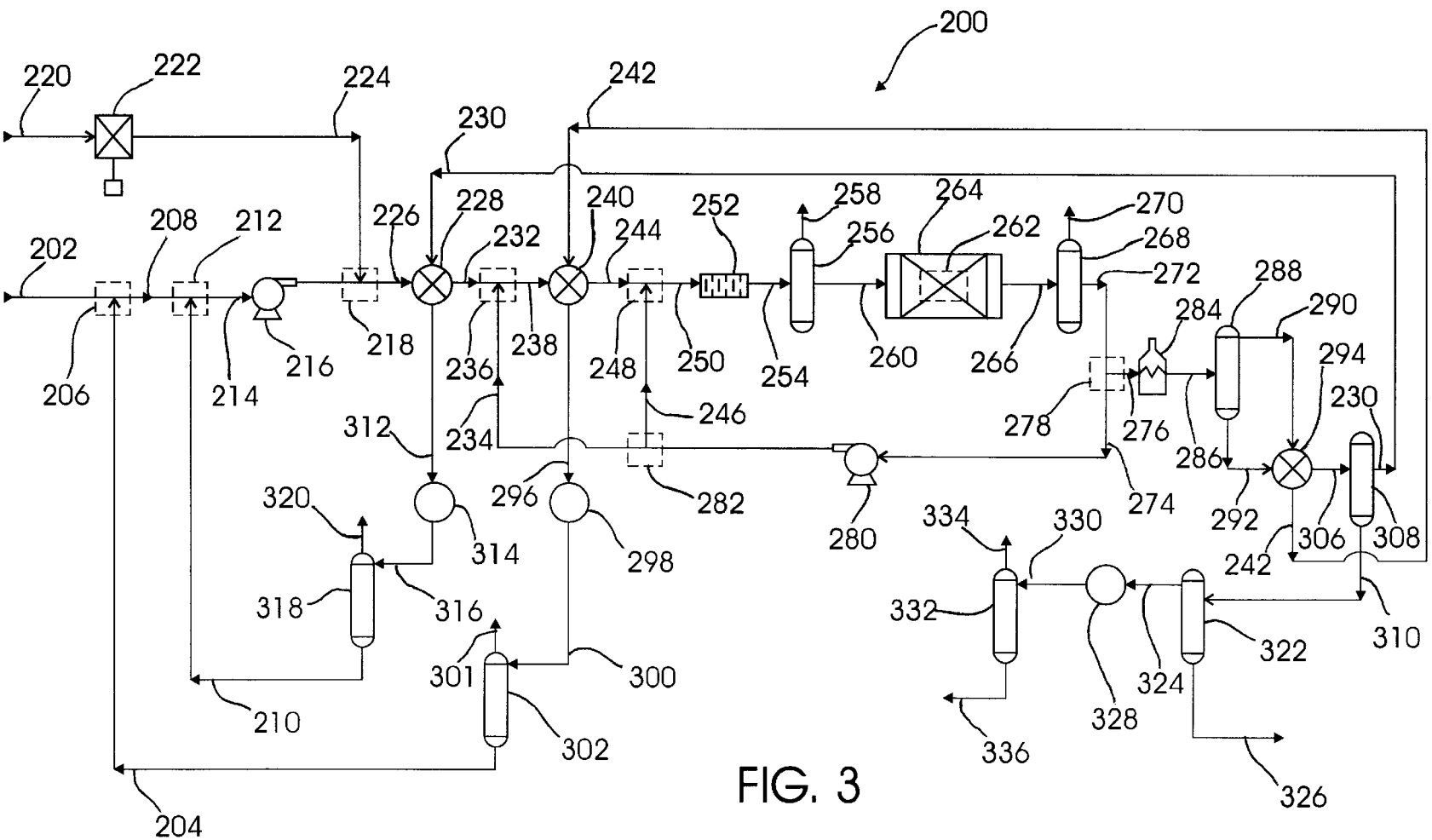
FIG. 3 is a schematic process flow diagram of a hydroprocessing system.

FIG. 3 shows a schematic process flow diagram for a hydroprocessing unit generally designated by the numeral 200.

Fresh feed stock 202 is combined with a first diluent 204 at first combination area 206 to form first diluent-feed 208. First diluent-feed 208 is then combined with a second diluent 210 at second combination area 212 to form second diluent-feed 214. Second diluent-feed 214 is then pumped by diluent-feed charge pump 216 to third combination area 218.

Hydrogen 220 is input into hydrogen compressor 222 to make compressed hydrogen 224. The compressed hydrogen 224 flows to third combination area 218.

Second diluent-feed 214 and compressed hydrogen 224 are combined at third combination area 218 to form hydrogen-diluent-feed mixture 226. The hydrogen-diluent-feed mixture 226 then flows though feed-product exchanger 228 which warms the mixture 226, by use of the third separator exhaust 230, to form the first exchanger flow 232. First exchanger flow 232 and first recycle flow 234 are combined at forth combination area 236 to form first recycle feed 238.

The first recycle feed 238 then flows though first feed-product exchanger 240 which warms the mixture 238, by use of the exchanged first rectifier exchanged exhaust 242, to form the second exchanger flow 244. Second exchanger flow 244 and second recycle flow 246 are combined at fifth combination area 248 to form second recycle feed 250.

The second recycle feed 250 is then mixed in feed-recycle mixer 252 to form feed-recycle mixture 254. Feed-recycle mixture 254 then flows into reactor inlet separator 256.

Feed-recycle mixture 254 is separated in reactor inlet separator 256 to form reactor inlet separator waste gases 258 and inlet separated mixture 260. The reactor inlet separator waste gases 258 are flared or otherwise removed from the present system 200.

Inlet separated mixture 260 is combined with catalyst 262 in reactor 264 to form reacted mixture 266. Reacted mixture 266 flows into reactor outlet separator 268.

Reacted mixture 266 is separated in reactor outlet separator 268 to form reactor outlet separator waste gases 270 and outlet separated mixture 272. Reactor outlet separator waste gases 270 flow from the reactor outlet separator 268 and are then flared or otherwise removed from the present system 200.

Outlet separated mixture 272 flows out of reactor outlet separator 268 and is split into large recycle flow 274 and continuing outlet separated mixture 276 at first split area 278.

Large recycle flow 274 is pumped through recycle pumps 280 to second split area 282. Large recycle flow 274 is split at combination area 282 into first recycle flow 234 and second recycle flow 246 which are used as previously discussed.

Continuing outlet separated mixture 276 leaves first split area 278 and flows into effluent heater 284 to become heated effluent flow 286.

Heated effluent flow 286 flows into first rectifier 288 where it is split into first rectifier exhaust 290 and first rectifier flow 292. First rectifier exhaust 290 and first rectifier flow 292 separately flow into second exchanger 294 where their temperatures difference is reduced.

The exchanger transforms first rectifier exhaust 290 into first rectifier exchanged exhaust 242 which flows to first feed-product exchanger 240 as previously described. First feed-product exchanger 240 cools first rectifier exchanged exhaust 242 even further to form first double cooled exhaust 296.

First double cooled exhaust 296 is then cooled by condenser 298 to become first condensed exhaust 300. First condensed exhaust 300 then flows into reflux accumulator 302 where it is split into exhaust 304 and first diluent 204. Exhaust 304 is exhausted from the system 200. First diluent 204 flows to first combination area 206 to combine with the fresh feed stock 202 as previously discussed.

The exchanger transforms first rectifier flow 292 into first rectifier exchanged flow 306 which flows into third separator 308. Third separator 308 splits first rectifier exchanged flow 306 into third separator exhaust 230 and second rectified flow 310.

Third separator exhaust 230 flows to exchanger 228 as previously described. Exchanger 228 cools third separator exhaust 230 to form second cooled exhaust 312.

Second cooled exhaust 312 is then cooled by condenser 314 to become third condensed exhaust 316. Third condensed exhaust 316 then flows into reflux accumulator 318 where it is split into reflux accumulator exhaust 320 and second diluent 210. Reflux accumulator exhaust 320 is exhausted from the system 200. Second diluent 210 flows to second combination area 212 to rejoin the system 200 as previously discussed.

Second rectified flow 310 flows into second rectifier 322 where it is split into third rectifier exhaust 324 and first end flow 326. First end flow 326 then exits the system 200 for use or further processing. Third rectifier exhaust 324 flows into condenser 328 where it is cooled to become third condensed exhaust 330.

Third condensed exhaust 330 flows from condenser 328 into fourth separator 332. Fourth separator 332 splits third condensed exhaust 330 into fourth separator exhaust 334 and second end flow 336. Fourth separator exhaust 334 is exhausted from the system 200. Second end flow 336 then exits the system 200 for use or further processing.

Figure 4:
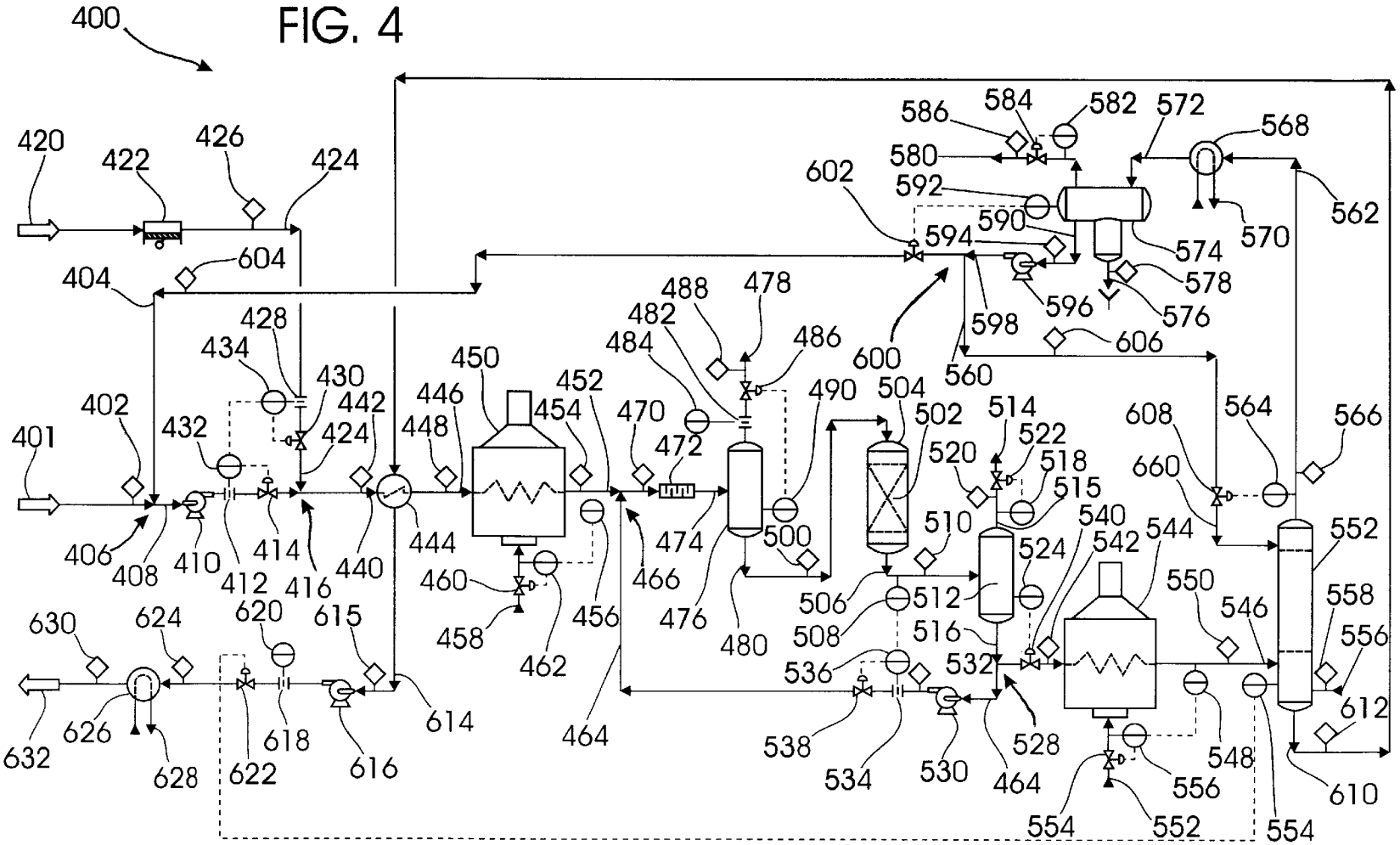
FIG. 4 is a schematic process flow diagram of a multistage reactor system.

FIG. 4 shows a schematic process flow diagram for a 1200 BPSD hvdroprocessing unit generally designated by the numeral 400.

Fresh feed stock 401 is monitored at first monitoring point 402 for acceptable input parameters of approximately 260° F., at 20 psi, and 1200 BBL/D. Tile fresh feed stock 401 is then combined with a diluent 404 at first combination area 406 to form combined diluent-feed 408. Combined diluent-feed 408 is the pumped by diluent-feed charge pump 410 through first monitoring orifice 412 and first valve 414 to second combination area 416.

Hydrogen 420 is input at parameters of 100° F., 500 psi, and 40000 SCF/HR into hydrogen compressor 422 to make compressed hydrogen 424. The hydrogen compressor 422 compresses the hydrogen 420 to 1500 psi. The compressed hydrogen 424 flows through second monitoring point 426 where it is monitored for acceptable input parameters. The compressed hydrogen 424 flows through second monitoring orifice 428 and second valve 430 to second combination area 416.

First monitoring orifice 412, first valve 414, and FFIC 434 are connected to FIC 432 which controls the incoming flow of combined diluent-feed 408 to second combination area 416. Similarly, second monitoring orifice 428, second valve 430, and FIC 432 are connected to FFIC 434 which controls the incoming flow of compressed hydrogen 424 to second combination area 416. Combined diluent-feed 408 and compressed hydrogen 424 are combined at second combination area 416 to form hydrogen-diluent-feed mixture 440. The mixture parameters arc approximately 1500 psi and 2516 BBL/D which are monitored at fourth monitoring point 442. The hydrogen-diluent-feed mixture 440 then flows though feed-product exchanger 444 which warms the hydrogen-diluent-feed mixture 440, by use of the rectified product 610, to form the exchanger flow 446. The feed-product exchanger 444 works at approximately 2.584 MMBTU/HR.

The exchanger flow 446 is monitored at fifth monitoring point 448 to gather information about the parameters of the exchanger flow 446.

The exchanger flow 446 then travels into the reactor preheater 450 which is capable of heating the exchange flow 446 at 5.0 MMBTU/HR to create the preheated flow 452. Preheated flow 452 is monitored at sixth monitoring point 454 and by TIC 456.

Fuel gas 458 flows though third valve 460 and is monitored by PIC 462 to supply the fuel for the reactor preheater 450. PIC 462 is connected to third valve 460 and TIC 456.

Preheated flow 452 is combined with recycle flow 464 at third combination area 466 to form preheated-recycle flow 468. Preheated-recycle flow 468 is monitored at seventh monitoring point 470. The preheated-recycle flow 468 is then mixed in feed-recycle mixer 472 to form feed-recycle mixture 474. Feed-recycle mixture 474 then flows into reactor inlet separator 476. The reactor inlet separator 476 has parameters of 60" I.D.×10' 0"S/S.

Feed-recycle mixture 474 is separated in reactor inlet separator 476 to form reactor inlet separator waste gases 478 and inlet separated mixture 480. Reactor inlet separator waste gases 478 flow from the reactor inlet separator 476 through third monitoring orifice 482 which is connected to FI 484. The reactor inlet separator waste gases 478 then travel through fourth valve 486, past eighth monitoring point 488 and are then flared or otherwise removed from the present system 400.

LIC 490 is connected to both fourth valve 486 and reactor inlet separator 476.

Inlet separated mixture 480 flows out of the reactor inlet separator 476 with parameters of approximately 590° F. and 1500 psi which are monitored at ninth monitoring point 500.

Inlet separated mixture 480 is combined with catalyst 502 in reactor 504 to form reacted mixture 506. Reacted mixture 506 is monitored by TIC 508 and at tenth monitoring point 510 for processing control. The reacted mixture 506 has parameters of 605° F. and 1450 psi as it flows into reactor outlet separator 512.

Reacted mixture 506 is separated in reactor outlet separator 512 to form reactor outlet separator waste gases 514 and outlet separated mixture 516. Reactor outlet separator waste gases 514 flow from the reactor outlet separator 512 through monitor 515 for PIC 518. The reactor outlet separator waste gases 514 then travel past eleventh monitoring point 520 and through fifth valve 522 and are then flared or otherwise removed from the present system 400.

The reactor outlet separator 512 is connected to controller LIC 524. The reactor outlet separator 512 has parameters of 60" I.D.×10'–0" S/S.

Outlet separated mixture 516 flows out of reactor outlet separator 512 and is split into both recycle flow 464 and continuing outlet separated mixture 526 at first split area 528.

Recycle flow 464 is pumped through recycle pumps 530 and past twelfth monitoring point 532 to fourth monitoring orifice 534. Fourth monitoring orifice 534 is connected to FIC 536 which is connected to TIC 508. FIC 536 controls sixth valve 538. After the recycle flow 464 leaves fourth monitoring orifice 534, the flow 464 flows through sixth valve 538 and on to third combination area 466 where it combines with preheated flow 452 as previously discussed.

Outlet separated mixture 526 leaves first split area 528 and flows through seventh valve 540 which is controlled by LIC 524. Outlet separated mixture 526 then flows past thirteenth monitoring point 542 to effluent heater 544.

Outlet separated mixture 526 then travels into the effluent heater 544 which is capable of heating the outlet separated mixture 526 at 3.0 MMBTU/HR to create the heated effluent flow 546. The heated effluent flow 546 is monitored by TIC 548 and at fourteenth monitoring point 550. Fuel gas 552 flows though eighth valve 554 and is monitored by PIC 556 to supply the fuel for the effluent heater 544. PIC 556 is connected to eighth valve 554 and TIC 548.

Heated effluent flow 546 flows from fourteenth monitoring point 550 into rectifier 552. Rectifier 552 is connected to LIC 554. Steam 556 flows into rectifier 552 through twentieth monitoring point 558. Return diluent flow 560 also flows into rectifier 552. Rectifier 552 has parameters of 42" I.D.×54'–0" S/S.

Rectifier diluent 562 flows out of rectifier 552 past monitors for TIC 564 and past fifteenth monitoring point 566. Rectifier diluent 562 then flows through rectifier ovhd, condenser 568. Rectifier ovhd, condenser 568 uses flow CWS/R 570 to change rectifier diluent 562 to form condensed diluent 572. Rectifier ovhd, condenser 568 has parameters of 5.56 MMBTU/HR.

Condensed diluent 572 then flows into rectifier reflux accumulator 574. Rectifier reflux accumulator 574 has parameters of 42" I.D.×10'–0" S/S. Rectifier reflux accumulator 574 is monitored by LIC 592. Rectifier reflux accumulator 574 splits the condensed diluent 572 into three streams: drain stream 576, gas stream 580, and diluent stream 590.

Drain stream 576 flows out of rectifier reflux accumulator 574 and past monitor 578 out of the system 400.

Gas stream 580 flows out of rectifier reflux accumulator 574, past a monitoring for PIC 582, through ninth valve 584, past fifteenth monitoring point 586 and exits the system 400. Ninth valve 584 is controlled by PIC 582.

Diluent stream 590 flows out of rectifier reflux accumulator 574, past eighteenth monitoring point 594 and through pump 596 to form pumped diluent stream 598. Pumped diluent stream 598 is then split into diluent 404 and return diluent flow 560 at second split area 600. Diluent 404 flows from second split area 600, through tenth valve 602 and third monitoring point 604. Diluent 404 then flows from third monitoring point 604 to first combination area 406 where it combines with fresh feed stock 401 as previously discussed.

Return diluent flow 560 flows from second split area 600, past nineteenth monitoring point 606, through eleventh valve 608 and into rectifier 552. Eleventh valve 608 is connected to TIC 564.

Rectified product 610 flows out of rectifier 552, past twenty first monitoring point 612 and into exchanger 444 to form exchanged rectified product 614. Exchanged rectified product 614 then flows past twenty second monitoring point 615 and through product pump 616. Exchanged rectified product 614 flows from pump 616 through fifth monitoring orifice 618. Sixth monitoring orifice 618 is connected to FI 620. Exchanged rectified product then flows from sixth monitoring orifice 618 to twelfth valve 622. Twelfth valve 622 is connected to LIC 554. Exchanged rectified product 614 then flows from twelfth valve 622 through twenty third monitoring point 624 and into product cooler 626 where it is cooled to form final product 632. Product Cooler 626 uses CWS/R 628. Product cooler has parameters of 0.640 MMBTU/HR. Final product 632 flows out of cooler 626, past twenty fourth monitoring point 630 and out of the system 400.

Figure 5:
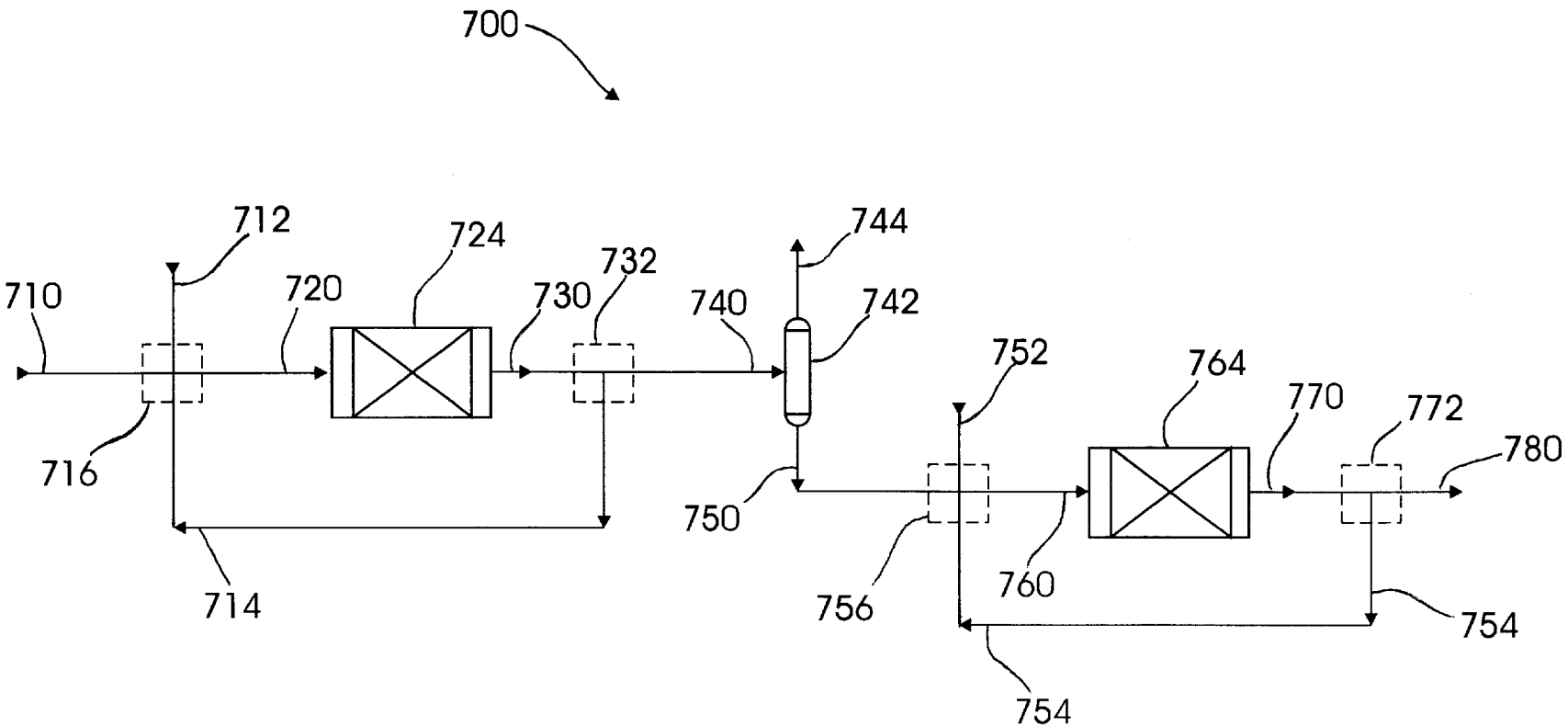
FIG. 5 is a schematic process flow diagram of a 1200 BPSD hydroproccssing unit.

FIG. 5 shows a schematic process flow diagram for a multistage hydrotreater generally designated by the numeral 700. Feed 710 is combined with hydrogen 712 and first recycle stream 714 in area 716 to form combined feed-hydrogen-recycle stream 720. The combined feed-hydrogen-recycle stream 720 flows into first reactor 724 where it is reacted to form first reactor output flow 730. The first reactor output flow 730 is divided to form first recycle stream 714 and first continuing reactor flow 740 at area 732. First continuing reactor flow 740 flows into stripper 742 where stripper waste gases 744 such as $H_2S$, $NH_3$, and $H_2O$ are removed to form stripped flow 750.

Stripped flow 750 is then combined with additional hydrogen 752 and second recycle stream 754 in area 756 to form combined stripped-hydrogen-recycle stream 760. The combined stripped-hydrogen-recycle stream 760 flows into saturation reactor 764 where it is reacted to form second reactor output flow 770. The second reactor output flow 770 is divided at area 772 to form second recycle stream 754 and product output 780.

In accordance with the present invention, deasphalting solvents include propane, butanes, and/or pentanes. Other feed diluents include light hydrocarbons, light distillates, naptha, diesel, VGO, previously hydroprocessed stocks, recycled hydrocracked product, isomerized product, recycled demetaled product, or the like.

EXAMPLE 1

A feed selected from the group of petroleum fractions, distillates, resids, waxes, lubes, DAO, or fuels other than diesel fuel is hydrotreated at 620 K to remove sulfur and nitrogen. Approximately 200 SCF of hydrogen must be reacted per barrel of diesel fuel to make specification product. The diluent is selected from the group of propane, butane, pentane, light hydrocarbons, light distillates, naptha, diesel, VG0, previously hydroprocessed stocks, or combinations thereof A tubular reactor operating at 620 K outlet temperature with a 1/1 or 2/1 recycle to feed ratio at 65 or 95 bar is sufficient to accomplish the desired reactions.

EXAMPLE 2

A feed selected from the group of petroleum fractions, distillates, resids, oils, waxes, lubes, DAO, or the like other than deasphalted oil is hydrotreated at 620 K to remove sulfur and nitrogen and to saturate aromatics. Approximately 1000 SCF of hydrogen must be reacted per barrel of deasphalted oil to make specification produce. The diluent is selected from the group of propane, butane, pentane, light hydrocarbons, light distillates, naptha, diesel. VG0, previously hydroprocessed stocks, or combinations thereof. A tubular reactor operating at a 620 K outlet temperature and 80 bar with a recycle ratio of 2.5/1 is sufficient to provide all of the hydrogen required and allow for a less than 20 K temperature rise through the reactor.

EXAMPLE 3

A two phase hydroprocessing method and apparatus as described and shown herein.

EXAMPLE 4

In a hydroprocessing method, the improvement comprising the step of mixing and/or flashing the hydrogen and the oil to be treated in the presence of a solvent or diluent in which the hydrogen solubility is high relative to the oil feed.

EXAMPLE 5

The Example 4 above wherein the solvent or diluent is selected from the group of heavy naptha, propane, butane, pentane, light hydrocarbons, light distillates, naptha diesel, VG0, previously hydroprocessed stocks, or combinations thereof.

EXAMPLE 6

The Example 5 above wherein the feed is selected from the group of oil, petroleum fraction, distillate, resid, diesel fuel, deasphalted oil, waxes, lubes, and the like.

EXAMPLE 7

A two phase hydroprocessing method comprising the steps of blending a feed with a diluent, saturating the diluent/feed mixture with hydrogen ahead of a reactor reacting the feed/diluent/hydrogen mixture with a catalyst in the reactor to saturate or remove sulphur, nitrogen, oxygen, metals, or other contaminants, or for molecular weight reduction or cracking.

EXAMPLE 8

The Example 7 above wherein the reactor is kept at a pressure of 500–5000 psi, preferably 1000–3000 psi.

EXAMPLE 9

The Example 8 above further comprising the step of running the reactor at super critical solution conditions so that there is no solubility limit.

EXAMPLE 10

The Example 9 above further comprising the step of removing heat from the reactor affluent, separating the diluent from the reacted feed, and recycling the diluent to a point upstream of the reactor.

EXAMPLE 11

A hydroprocessed, hydrotreated, hydrofinished, hydrorefined, hydrocracked, or the like petroleum product produced by one of the above described Examples.

EXAMPLE 12

A reactor vessel for use in the improved hydrotreating process of the present invention includes catalyst in relatively small tubes of 2-inch diameter, with an approximate reactor volume of 40 $ft.^3$, and with the reactor built to withstand pressures of up to about only 3000 psi.

EXAMPLE 13

In a solvent deasphalting process eight volumes of n butane are contacted with one volume of vacuum tower bottoms. After removing the pitch but prior to recovering the solvent from the deasphalted oil (DAO) the solvent/DAO mix is pumped to approximately 1000–1500 psi and mixed with hydrogen, approximately 900 SCF $H_2$ per barrel of DAO. The solvent/DAO/$H_2$ mix is heated to approximately 590K–620K and contacted with catalyst for removal of sulfur, nitrogen and saturation of aromatics. After hydrotreating the butane is recovered from the hydrotreated DAO by reducing the pressure to approximately 600 psi.

EXAMPLE 14

At least one of the examples above including multi-stage reactors, wherein two or more reactors are placed in series with the reactors configured in accordance with the present invention and having the reactors being the same or different with respect to temperature, pressure, catalyst, or the like.

EXAMPLE 15

Further to Example 14 above, using multi-stage reactors to produce specialty products, waxes, lubes, and the like.

Briefly, hydrocracking is the breaking of carbon-carbon bonds and hydroisomerization is the rearrangement of carbon-carbon bonds. Hydrodemetalization is the removal of metals, usually from vacuum tower bottoms or deasphalted oil, to avoid catalyst poisoning in cat crackers and hydrocrackers.

EXAMPLE 16

Hydrocracking: A volume of vacuum gas oil is mixed with 1000 SCF $H_2$ per barrel of gas oil feed and blended with two volumes of recycled hydrocracked product (diluent) and passed over a hydrocracking catalyst of 750° F. and 2000 psi. The hydrocracked product contained 20 percent naphtha, 40 percent diesel and 40 percent resid.

EXAMPLE 16

Hydroisomerization: A volume of feed containing 80 percent paraffin wax is mixed with 200 SCF $H_2$ per barrel of feed and blended with one volume if isomerized product as diluent and passed over an isomerization catalyst at 550° F. and 2000 psi. The isomerized product has a pour point of 30° F. and a VI of 140.

EXAMPLE 18

Hydrodemetalization: A volume of feed containing 80 ppm total metals is blended with 150 SCF $H_2$ per barrel and mixed with one volume of recycled demetaled product and passed over a catalyst at 450° F. and 1000 psi. The product contained 3 ppm total metals.

Generally, Fischer-Tropsch refers to the production of paraffins from carbon monoxide and hydrogen (CO & $H_2$ or synthesis gas). Synthesis gas contains $CO_2$, CO,$H_2$ and is produced from various sources, primarily coal or natural gas. The synthesis gas is then reacted over specific catalysts to produce specific products.

Fischer-Tropsch synthesis is the production of hydrocarbons, almost exclusively paraffins, from CO and $H_2$ over a supported metal catalyst. The classic Fischer-Tropsch catalyst is iron, however other metal catalysts are also used.

Synthesis gas can and is used to produce other chemicals as well, primarily alcohols, although these are not Fischer-Tropsch reactions. The technology of the present invention can be used for any catalytic process where one or more components must be transferred from the gas phase to the liquid phase for reaction on the catalyst surface.

EXAMPLE 19

A two stage hydroprocessing method, wherein the first stage is operated at conditions sufficient for removal of sulfur, nitrogen, oxygen, and the like (620 K, 100 psi), after which the contaminants $H_2S$, $NH_3$ and water are removed and a second stage reactor is then operated at conditions sufficient for aromatic saturation.

EXAMPLE 20

The process as recited in at least one of the examples above, wherein in addition to hydrogen, carbon monoxide (CO) is mixed with the hydrogen and the mixture is contacted with a Fischer-Tropsch catalyst for the synthesis of hydrocarbon chemicals.

In accordance with the present invention, an improved hydroprocessing, hydrotreating, hydrofinishing, hydrorefining, and/or hydrocracking process provides for the removal of impurities from lube oils and waxes at a relatively low pressure and with a minimum amount of catalyst by reducing or eliminating the need to force hydrogen into solution by pressure in the reactor vessel and by increasing the solubility for hydrogen by adding a diluent or a solvent. For example, a diluent for a heavy cut is diesel fuel and a diluent for a light cut is pentane. Moreover, while using pentane as a diluent, one can achieve high solubility. Further, using the process of the present invention one can achieve more than a stoichiometric requirement of hydrogen in solution. Also, by utilizing the process of the present invention, one can reduce cost of the pressure vessel and can use catalyst in small tubes in the reactor and thereby reduce cost. Further, by utilizing the process of the present invention, one may be able to eliminate the need for a hydrogen recycle compressor.

Although the process of the present invention can be utilized in conventional equipment for hydroprocessing, hydrotreating, hydrofinishing, hydrorefining and/or hydrocracking, one can achieve the same or a better result using lower cost equipment, reactors, hydrogen compressors, and the like by being able to run the process at a lower pressure, and/or recycling solvent, diluent, hydrogen, or at least a portion of the previously hydroprocessed stock or feed.

What is claimed is:

1. A hydroprocessing method comprising:

combining a liquid feed with reactor effluent and flashing with hydrogen, then separating any gas from the liquid upstream of the reactor and then contacting the feed/effluent/hydrogen mixture with a catalyst in the reactor, removing the contacted liquid from the reactor at an intermediate position, combining the removed liquid with hydrogen gas to resaturate with hydrogen, separating the gas from the liquid and reintroducing the removed liquid back into the reactor at the point the removed liquid was withdrawn.

2. The method of claim 1, wherein liquid from the reactor is introduced into a second reactor containing a different catalyst.

3. A hydroprocessing method for treating an oil feed with hydrogen in a reactor, comprising:

mixing and flashing the hydrogen and oil feed to be treated in the presence of a solvent or diluent wherein the percentage of hydrogen in solution is greater than the percentage of hydrogen in the feed to form a liquid feed/diluent/hydrogen mixture, then separating any gas from the liquid mixture upstream of the reactor, and then contacting the liquid feed/diluent/hydrogen mixture with a catalyst in the reactor to at least one of remove contaminants and saturate aromatics.

4. The method as recited in claim 3 wherein the solvent or diluent is selected from the group of heavy naphtha, propane, butane, pentane, light hydrocarbons, light distillates, naphtha, diesel, VGO, previously hydroprocessed stocks, or combinations thereof.

5. The method as recited in claim 4 wherein the feed is selected from the group of oil, petroleum fraction, distillate, resid, diesel fuel, deasphalted oil, waxes, lubes, and specialty products.

6. A hydroprocessing method comprising blending a feed with a diluent, saturating the diluent/feed mixture with hydrogen ahead of a reactor to form a liquid feed/diluent/hydrogen mixture, separating any excess gas from the liquid mixture ahead of the reactor, and then contacting the liquid feed/diluent/hydrogen mixture with a catalyst in the reactor to remove at least one of sulphur, nitrogen, oxygen, metals, and combinations thereof.

7. The method as recited in claim 6, wherein the reactor is kept at a pressure of 500–5000 psi.

8. The method as recited in claim 7, further comprising the step of running the reactor at super critical solution conditions so that there is no solubility limit.

9. The method as recited in claim 6, wherein the process is a multi-stage process using a series of two or more reactors.

10. The method as recited in claim 8, further comprising the step of removing heat from the reactor effluent, separating the diluent from the reacted feed, and recycling the diluent to a point upstream of the reactor.

11. The method as recited in claim 6, wherein multiple reactors arc used to remove at least one of sulphur, nitrogen, oxygen, metals, and combinations thereof and then to saturate aromatics.

12. The method as recited in claim 6, wherein a portion of the reacted feed is recycled and mixed with the blended feed ahead of the reactor.

13. The method as recited in claim 9, wherein a first stage is operated at conditions sufficient for removal of sulfur, nitrogen, and oxygen contaminants from the feed, at least 620 K, 100 psi, after which, the contaminant $H_2S$, $NH_3$ and water are removed and a second stage reactor is then operated at conditions sufficient for aromatic saturation of the processed feed.

14. The method as recited in claim 13, wherein in addition to hydrogen, CO (carbon monoxide) is mixed with the hydrogen and the resultant liquid feed/diluent/hydrogen/CO mixture is contacted with a Fischer-Tropsch catalyst in the reactor for the synthesis of hydrocarbon chemicals.

15. The method as recited in claim 3, wherein in addition to hydrogen, CO (carbon monoxide) is mixed with the hydrogen and the resultant feed/diluent/hydrogen/CO mixture is contacted with a Fischer-Tropsch catalyst in the reactor for the synthesis of hydrocarbon chemicals.

16. The method as recited in claim 6, wherein in addition to hydrogen, CO (carbon monoxide) is mixed with the hydrogen and the resultant feed/diluent/hydrogen/CO mixture is contacted with a Fischer-Tropsch catalyst in the reactor for the synthesis of hydrocarbon chemicals.

17. The method as recited in claim 6, wherein the reactor is kept at a pressure of 1000–3000 psi.

18. The method as recited in claim 1, wherein the reactor is kept at a pressure of 500–5000 psi.

19. The method as recited in claim 1, wherein the reactor is kept at a pressure of 1000–3000 psi.

20. The method as recited in claim 1, further comprising the step of running the reactor at super critical solution conditions so that there is no solubility limit.

21. The method as recited in claim 1, wherein the process is a multi-stage process using a series of two or more reactors.

22. The method as recited in claim 20, further comprising removing heat from the reactor effluent, separating diluent from the reacted feed, recycling the diluent to a point upstream of the reactor.

23. The method as recited in claim 1, wherein multiple reactors are used to remove at least one of sulphur, nitrogen, oxygen, metals, and combinations thereof and then to saturate aromatics.

24. The method as recited in claim 1, wherein a portion of the reacted feed is recycled and mixed with the blended feed ahead of the reactor.

25. The method as recited in claim 21, wherein the first stage is operated at conditions sufficient for removal of sulfur, nitrogen, and oxygen contaminants from the feed, at least 620 K, 100 psi, after which, the contaminant $H_2S$, $NH_3$ and water are removed and a second stage reactor is then operated at conditions sufficient for aromatic saturation of the processed feed.

26. The method as recited in claim 1, wherein multiple reactors are used for molecular weight reduction.

27. The method as recited in claim 1, wherein multiple reactors are used for cracking.

28. The method as recited in claim 12, wherein said recycled and mixed reacted feed reduces the temperature rise through the reactor.

29. The method as recited in claim 24, wherein said recycled and mixed reacted feed reduces the temperature rise through the reactor.

30. The method as recited in claim 12, wherein the recycle ratio is about 1/1 to 2.5/1 based on volume.

31. The method as recited in claim 24, wherein the recycle ratio is about 1/1 to 2.5/1 based on volume.

* * * * *